US008830061B2

(12) United States Patent
Malhotra

(10) Patent No.: US 8,830,061 B2
(45) Date of Patent: Sep. 9, 2014

(54) PORTABLE REVERSE ALARM SYSTEM

(76) Inventor: Kiran Malhotra, Melbourne, FL (US)

( * ) Notice: Subject to any disclaimer, the term of this patent is extended or adjusted under 35 U.S.C. 154(b) by 99 days.

(21) Appl. No.: 13/463,590

(22) Filed: May 3, 2012

(65) Prior Publication Data

US 2012/0313784 A1 Dec. 13, 2012

Related U.S. Application Data

(60) Provisional application No. 61/482,432, filed on May 4, 2011.

(51) Int. Cl.
*G08B 13/14* (2006.01)

(52) U.S. Cl.
CPC ..... *G08B 13/1436* (2013.01)
USPC ..... 340/568.1; 340/571; 340/506; 340/572.4

(58) Field of Classification Search
USPC ..... 340/568.1, 571, 572.4, 506, 539.23, 340/686.6, 3.1, 6.1
See application file for complete search history.

(56) References Cited

U.S. PATENT DOCUMENTS 3,703,714 A 11/1972 Andrews
5,510,765 A 4/1996 Madau
5,648,754 A 7/1997 Hwang
5,680,096 A 10/1997 Grasmann
H1713 H 3/1998 Pearlman
5,905,432 A 5/1999 Greene
5,963,131 A * 10/1999 D'Angelo et al. ..... 340/568.1
6,535,116 B1 3/2003 Zhou
7,061,378 B2 * 6/2006 Lawrenson et al. ..... 340/568.1
7,190,264 B2 * 3/2007 Brown et al. ..... 340/539.23
7,315,237 B2 1/2008 Shimonomoto
2003/0071729 A1 4/2003 Adolphson
2006/0220834 A1 10/2006 Maeng

* cited by examiner

*Primary Examiner* — Toan N Pham
(74) *Attorney, Agent, or Firm* — Stephen C. Thomas

(57) ABSTRACT

A portable alarm system for notifying a user of theft or movement of an object when the user is at a distance from the object. The portable alarm system may generally comprise a sensor unit and a remote unit. The sensor unit may be placed on or embedded within an object to be protected and have one or more sensors for detecting vibration and/or motion of the sensor unit and thereby the object. The sensor unit is activated when vibration or movement input exceeds a predetermined trigger level value. When the trigger level value is exceeded, an alarm signal is transmitted to the remote unit. The remote unit receives the alarm signal and may generate one or more alarms to indicate object vibration or movement. The one or more alarms may include but are not limited to an audible buzzer, light indicators, and remote unit vibration.

7 Claims, 7 Drawing Sheets

PORTABLE REVERSE ALARM SYSTEM

CROSS REFERENCE TO RELATED APPLICATIONS

This non-provisional patent application claims the benefit of earlier filed U.S. provisional patent application No. 61/482,432, which was filed in the United States Patent and Trademark Office on May 4, 2011 and which is incorporated herein in its entirety by reference.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention relates generally to alarms and notification systems, and more particularly to an alarm system for alerting the owner of an object that the object has been moved or possibly taken. The present alarm activates a remote unit carried by the user, to notify the user if the remotely located object has been moved or taken. The remote unit includes means for remotely arming a sensor unit that may be on or embedded within the object.

2. Background Art

In today's society it is fairly commonplace for people to leave any one of their personal valuables unattended for an undetermined period of time. For example, people at coffee shops, restaurants, libraries, bars, and the like may leave personal items behind when they excuse themselves to go use the restroom and the like. People generally leave objects such as their purses, book bags, laptops, or other belongings on or near their table or seats at such establishments, but the objects are then left unattended with the owner potentially being removed a considerable distance away from the object.

While generally the odds are that no great harm may come to the object, the result may be disastrous if the object is intentionally or inadvertently taken by someone who lives far away and is just visiting the area and travels some great distance before realizing his or her error. While intentional theft is rare, it can occur, and the thief is likely to take the object to some other area well removed from the site of the theft in order to search and sell any valuable items or components. Thus, the owner whose object is taken, either intentionally or unintentionally, may have a very difficult time in having the object returned, if the owner is ever able to have the object returned at all.

It is well known and customary in the art to provide circuits which, for example, will sound the horn of a vehicle if the vehicle is bumped or an attempt at unauthorized access is made. For instance U.S. Pat. No. 5,510,765 to Madau describes a vehicle security system wherein Sound, vibration and motion are sensed within a motor vehicle to detect glass breakage and unauthorized intrusion into the interior or passenger compartment of the vehicle. Sound and vibration sensing are used to detect glass breakage with motion detection by means of radar or microwaves being utilized for intrusion detection to provide reliable recurring entry detection. The system may be operated to activate the motion sensing only after glass breakage is detected to permit persons and pets to occupy a motor vehicle having a security sensor system which is fully armed. Numerical values are assigned to specific physical sounds and vibrations with the resulting totals being compared to a trigger level to determine whether glass breakage has occurred. However, the system of U.S. Pat. No. 5,510,765 does not allow for remote alarm, nor is it portable and therefore it is not able to be used from object to object as the user desires.

Also, there are various preventive devices for preventing operation of the vehicle by an unauthorized individual. For instance U.S. Pat. No. 5,648,754 to Hwang describes car security system capable of sending out an alarm when a car door is opened by an unauthorized person comprises a power stabilizing circuit for providing working DC power for the security system, a signal amplifying circuit for detecting small voltage change signals in the car battery and for generating therefrom an amplified signal, an alarm circuit including a buzzer and a controlling transistor, a microprocessor for receiving and then evaluating the amplified signal. In operation, when a car door is opened, a voltage change signal is produced, which is then detected for evaluating whether the opening of car door is authorized. If a voltage change signal is detected during conditions other than the car door opening, it is identified as a false alarm. However, the system of U.S. Pat. No. 5,648,754 does not allow for remote alarm, nor is it portable and therefore able to be used from object to object as the user desires. Likewise, U.S. Pat. No. 5,680,096 to Grasmann discloses monitoring of a vehicle interior by detecting sound waves in a vehicle interior either from an incursion source or as reflected as echo waves wherein decomposing the electrical signals representing those detected sound waves into measurement vectors which are compared with sample vectors in a neural network so that a correlation parameter is generated which triggers an alarm when the correlation parameter indicates incursion. The system can respond first to glass breakage before an echo system is used to then further establish the nature of the incursion. However, the system of U.S. Pat. No. 5,680,096 does not allow for remote alarm, nor is it portable and therefore it is not able to be used from object to object as the user desires.

There exists, also, systems which may provide remote monitoring such as the system described in U.S. Pat. No. 3,703,714 to Andrews. This U.S. patent describes a remote alarm system for transmitting an alarm signal to a remote receiver when unauthorized access to a given installation is attempted. A remote portable radio transceiver is capable of receiving signals through the atmosphere from and transmitting signals through the atmosphere to a stationary radio transceiver which is operatively tuned to the remote transceiver for also receiving and transmitting signals from and to the remote transceiver. The stationary transceiver is located at the installation which is to be protected against unauthorized access, and a source of electrical energy is connected with the stationary transceiver. Connected to the installation as well as to the stationary transceiver is a switch for responding to an attempted unauthorized access so as to transmit a signal from the stationary transceiver to the remote transceiver. At the remote transceiver is an alarm which responds to the latter signal for warning the carrier of the remote transceiver that an attempted unauthorized access is being made at the installation. However, the remote alarm system of the U.S. Pat. No. 3,703,714 utilizes sensors that are not integrated with the transceiver and therefore must be hard-wired into place, such as wiring to the shift lever of a vehicle, door switch, window switch or the like. The disclosure of this patent application specifically defines the transceiver as "stationary", which, according to the disclosure, is defined as "the transceiver is stationary to the vehicle". Thus the sensor(s) and transceiver of the U.S. Pat. No. 3,703,714 are not portable because the sensor(s) and transceiver are not a single portable unit: and, furthermore, the U.S. Pat. No. 3,703,714 invention cannot be readily moved from object to object as the user desires.

Another remote monitoring system is disclosed in U.S. Pat. No. 5,905,432, which discloses a vehicle anti-theft and anti-vandalism alarm system having a vehicle monitor which comprises at least one vehicle battery, at least one vehicle microprocessor electrically connected to the at least one vehicle battery, a vehicle transmitter, a vehicle audio generator, a vehicle motion sensor, a vehicle vibration/movement sensor, and a portable monitor in communication with the vehicle monitor. The portable monitor comprises at least one portable monitor battery positioned within a portable monitor housing, at least one portable monitor microchip electrically connected to at least one portable monitor battery, a portable monitor receiver electrically connected to at least one portable monitor microchip, a portable monitor audio generator, a portable monitor illegal ENTRY visual indicator, a portable monitor SHOCK visual indicator electrically connected to at least one portable monitor microchip, a portable monitor switch electrically connected to at least one portable monitor microchip, and a vehicle microprocessor software program contained within the at least one vehicle microprocessor and a portable monitor microchip software program contained within the at least one portable monitor microchip. However, the remote alarm system of the U.S. Pat. No. 5,905,432 utilizes sensors that are not integrated with the transceiver and therefore must be hard-wired into place. Thus the sensor(s) and transceiver of the U.S. Pat. No. 3,703,714 are not portable because the sensor(s) and transceiver are not a single portable unit: and, furthermore, the U.S. Pat. No. 3,703,714 invention cannot be readily moved from object to object as the user desires.

At least one shortcoming of all systems of these prior devices is that they are localized at the object or vehicle which is to be protected against unauthorized movement or access and therefore cannot be readily moved from object to object as the user desires. Furthermore, many systems of the prior art do not enable remote monitoring of the object.

SUMMARY OF THE INVENTION

Accordingly, a need has arisen for a portable alarm system that alerts the owner of an object, when the object is remotely located from the owner, that the object has been moved or possibly taken. The present inventive portable alarm system comprises two basic components. The first component may comprise a portable sensor unit comprising at least one sensor and at least one transceiver that is attached or secured to the object to be protected or integrated or embedded within the structure of the object at its time of manufacture. The sensor unit may sense vibration, noise, or motion imparted on its sensors and thereby on the object as well. The attachment to the object may be by any means known in the art. The sensor unit may be comprised of any number of sensors. The second component may comprise a portable remote unit such as a small, key fob type device similar to those used with conventional car alarms. A user of the system of the present invention may arm one or more alarm sensor(s) on the sensor unit by using the remote unit that may be carried by the user. If the object is vibrated, lifted, or moved beyond a trigger level value, the sensor unit transmits an alarm signal, preferably as a Radio Frequency (RF) signal, from the object's location to the remote unit carried on the person of the user. The portable remote unit is activated by the alarm signal received from the portable sensor unit and thereafter notifies the user by an alarm indication that the object has been vibrated, lifted, or moved to at least a degree above the trigger level value monitored by the sensor unit. The alarm indication may be of any type known in the art, for example, but not limited to a beep or any other audible alarm, a vibration alarm, a light alarm, or any other alarm known in the art. Such alarm indication warns the user that there has potentially been, for instance, a vehicle break-in. Likewise, the system of the invention may be utilized for warning of the movement of a valuable item such as a Personal Computer (PC) or other object. Thus, the system of the invention has a broad array of usage and may be used to remotely monitor any object which the user desires. The portable sensor unit of the invention, for instance, may be moved to and used with a laptop computer, car, boat, motorcycle, musical instrument, backpack, suitcase, briefcase, or virtually any object which the user wishes to protect.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

The following documentation provides a detailed description of the invention.

Although a detailed description as provided herein contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

Figure 1:
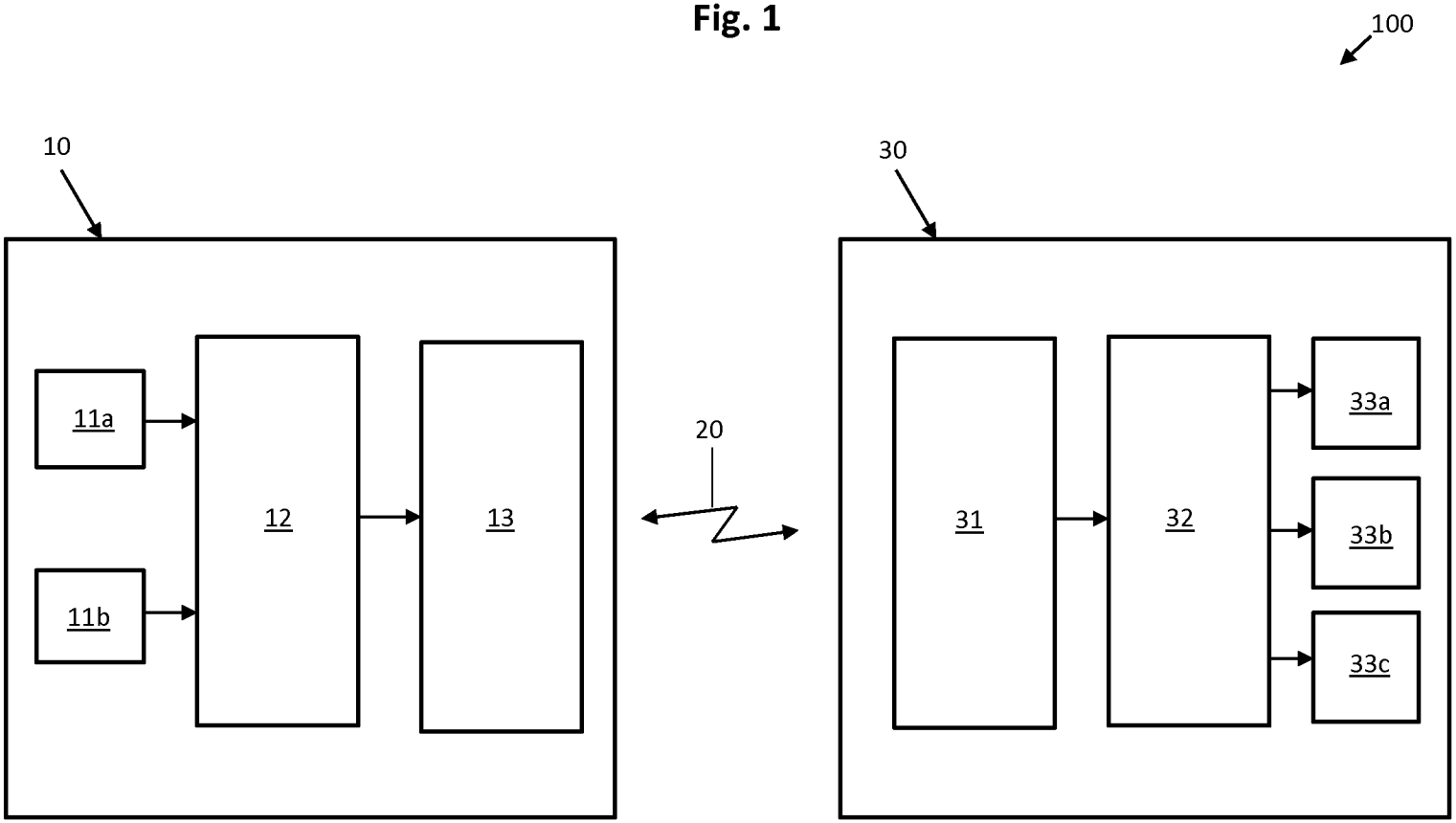
FIG. 1 depicts a diagram showing an arrangement of a portable alarm system in accordance with an embodiment of the present invention.

FIG. 1 illustrates a diagram of one embodiment of a portable alarm system 100 of the present invention. The system

100 may generally comprise a sensor unit 10 and a remote unit 30 wherein an alarm signal 20 may be communicated there between.

Figure 2:
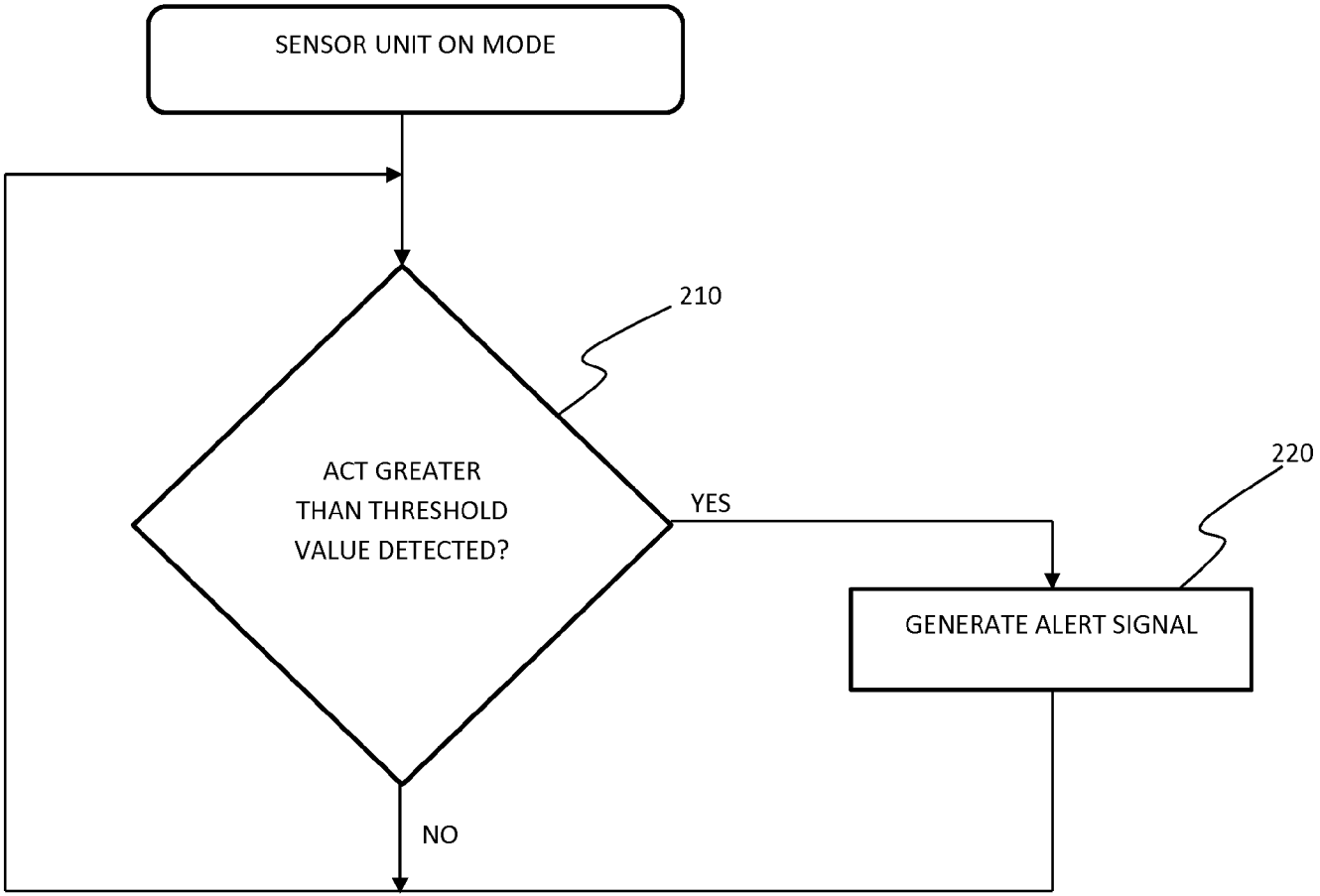
FIG. 2 depicts a flowchart of the processing executed by the sensor unit in accordance with an embodiment of the present invention.

The portable sensor unit 10 may be disposed in or on any object or item that the user desires to protect. The portable sensor unit 10 may comprise at least one sensor 11 that triggers the transmission of the alarm signal 20 when a predetermined sensor trigger level is exceeded. The sensor unit 10 may further comprise a sensor unit microcontroller chip 12 and at least one sensor unit transceiver 13. The sensor unit may also further comprise a sensor unit microcontroller readable memory which may be used for the storage of instructions for the operation of the sensor unit. Such sensor unit microcontroller readable memory may be physically incorporated into said sensor unit microcontroller chip or may be separate from said sensor unit microcontroller chip. As shown in FIG. 2, the sensor unit microcontroller chip 12 may compare the input from the at least one sensor 11 with the sensor trigger level value (step 210). If the input voltage generated is higher than the predetermined sensory trigger level, the sensor unit microcontroller chip 12 may then trigger the sensor unit transceiver 13 to transmit (step 220) an alarm signal 20 from the sensor unit 10 to the remote unit 30. In a preferred embodiment, the at least one sensor 11 of the sensor unit 10 may comprise any a motion sensor 11*a*, a noise sensor and/or a vibration sensor 11*b*, or any combination of sensors, for monitoring the protected object. The sensor unit may be powered by a battery contained within the sensor unit which may be rechargeable or single-use. The sensor unit may also be powered by a remote power source using a wire or any other connection as is known in the art.

When the sensor unit microcontroller chip 12 triggers the sensor unit transceiver 13 to transmit an alarm signal 20 from the sensor unit 10 to the remote unit 30, one or more alarms 33 may be activated on the remote unit 30 to warn the user of the sensed change in status of the protected object. The remote unit 30 may generally comprise a remote unit transceiver 31 that receives the alarm signal 20, a remote unit microcontroller chip 32 that may perform a variety of programs and a battery. The remote unit may also further comprise a remote unit microcontroller readable memory which may be used for the storage of instructions for the operation of the remote unit. Such remote unit microcontroller readable memory may be physically incorporated into said remote unit microcontroller chip or may be separate from said remote unit microcontroller chip. In a preferred embodiment, the one or more alarms 33 of the remote unit 30 may comprise at least one LED 33*a*, an audible buzzer 33*b*, and/or a vibrating motor 33*c* that may be activated either individually or in any combination upon receiving the alarm signal 20. In another preferred embodiment, the remote unit 30 may comprise a key fob or a pocket key chain device configuration.

The transceivers of the invention may be any RF transceiver capable of transmitting and receiving RF signals. The transceivers of the invention are preferably, but not necessarily, contained within a chipset or single chip designed for this purpose as are generally known in the art. For example, and not by way of limitation, such chipsets exist in the 900 MHz and 2.3 GHz frequency ranges. The physical form, wavelength, and signaling characteristics of the transceivers of the invention are not to be considered a limitation of the invention. Any transceiver small enough to allow portability of the sensor and remote units, and also capable of sending and receiving signals, are included within the scope of the invention.

In use, when the remote unit microcontroller chip 32 receives an alarm signal through the remote unit transceiver 31 one or more switch-controlled operations may take place. A first switch, such as an alert switch, may have at least two switch positions. When the remote unit microcontroller chip 32 receives an input signal and the first switch is in the first position (e.g. moved to the left), the at least one LED 33*a* may be activated and start blinking and provide a visual alarm, the audio buzzer 33*b* may be activated and emit an audible alarm, and the vibrating motor 33*c* may be activated and provide an additional tactile or vibrating alarm. When the remote unit microcontroller chip 32 receives an input signal and the first switch is in the second position (e.g. moved to the right), the at least one LED 33*a* may be activated and start blinking and provide a visual alarm and the vibrating motor 33*c* may be activated and provide an additional tactile or vibrating alarm. Thus, having the first switch in the second position may provide a "silent" alarm that may be seen and/or felt while the user may wish to silence the audible buzzer 33*b* such as while at work, in a meeting, or at a movie.

Figure 3:
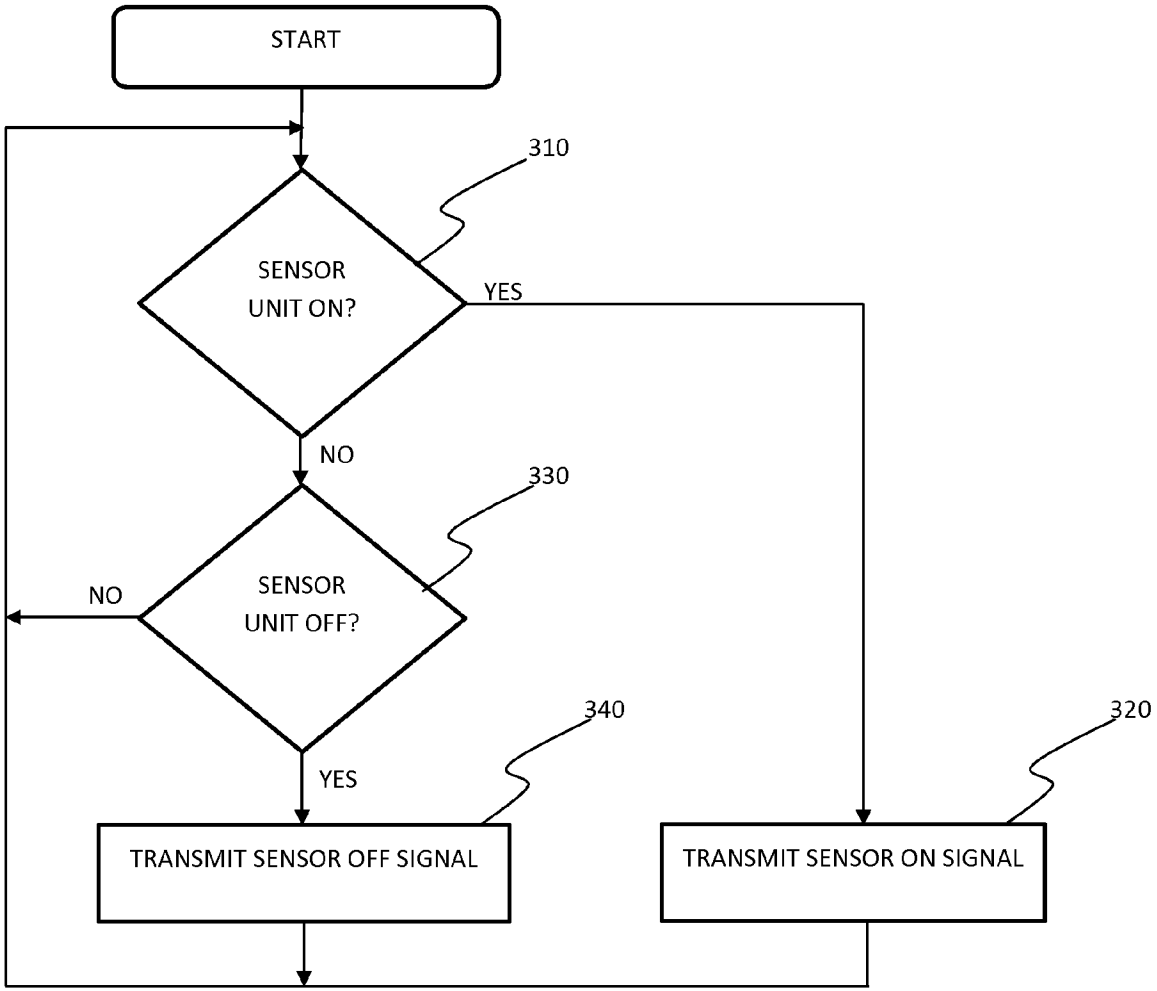
FIG. 3 depicts a flowchart of the processing executed by the remote unit in accordance with an embodiment of the present invention.
Figure 4:
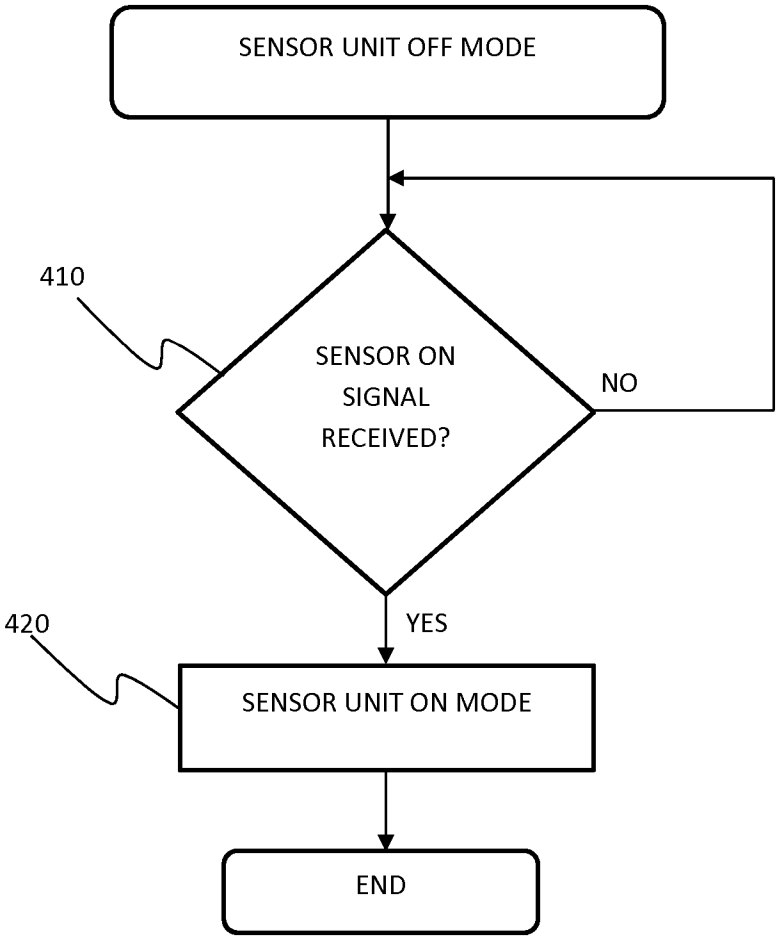
FIG. 4 depicts a flowchart of the processing executed by the sensor unit in accordance with an embodiment of the present invention to shift the operation mode in response to a sensor ON signal.

As generally shown in FIG. 4, a second switch on the remote unit 30 may be used to send (step 410) a sensor ON, or sensor active, signal to activate (step 420) the system 100 of the present invention. The remote unit second switch may activate the at least one sensor 11 of the sensor unit 10. As an indication to the user, a plurality of LEDs may be disposed on the sensor unit 10 and/or the remote unit 30. Specific lighting patterns may indicate to the user whether the system 100 is activated or deactivated at any given time. In a preferred embodiment, the plurality of LEDs may comprise two LEDs installed on each of the sensor unit 10 and remote unit 30 to act as a visual indicator of system activation status to the user. A predetermined LED pattern, such as both LEDs being lit without blinking, may be used to indicate that the system 100 and its at least one sensor are activated and monitoring the object having the sensor unit 10 associated therewith. FIG. 3 further depicts a simplified flow diagram for one embodiment of the system 100 of the present invention validating either the activated status of the sensor unit 10 (step 310) and maintaining the activated status (step 320) or the deactivated status of the sensor unit 10 (step 330) and maintaining the deactivated status (step 340). In this disclosure, sensor activate has the same meaning as sensor on, and sensor deactivate has the same meaning as sensor off.

Figure 5:
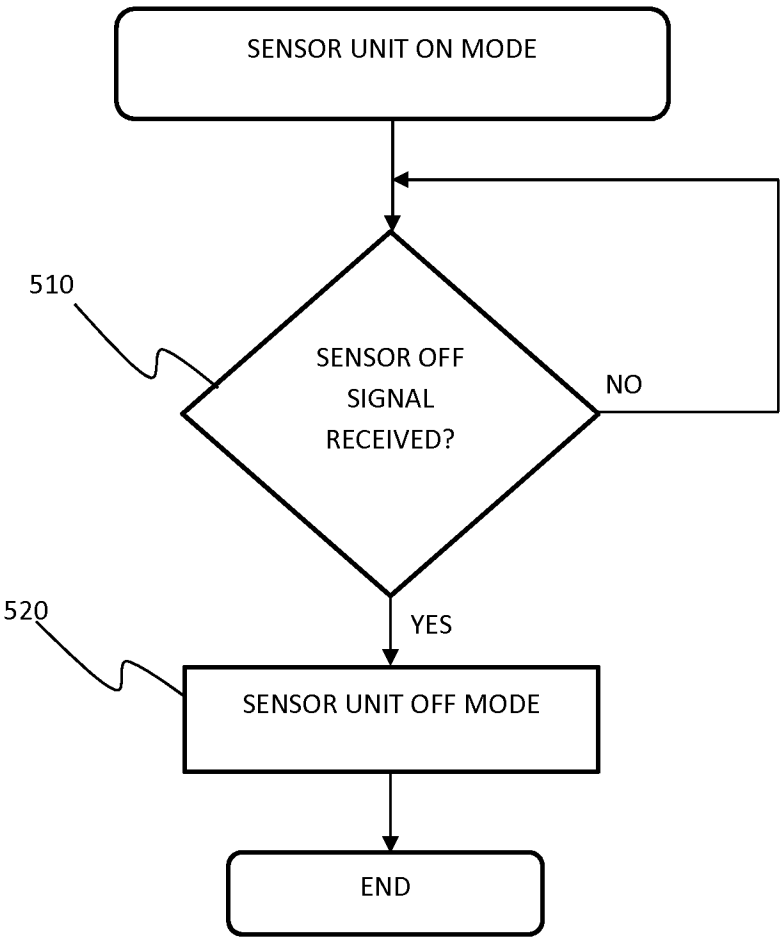
FIG. 5 depicts a flowchart of the processing executed by the sensor unit in accordance with an embodiment of the present invention to shift the operation mode in response to a sensor OFF signal.

As generally shown in FIG. 5, a third switch disposed on the remote unit 30 may be used to send (step 510) a sensor OFF, or sensor deactivate, signal to deactivate (step 520) the system 100 of the present invention. All switches disclosed herein may be triggered, toggled, or otherwise switched by any manner or structures known within the art. As a further example, the second and third switches disclosed above may be unified in one embodiment into a single switch that may be toggled between a system 100 activated position and a system 100 deactivated position.

Figure 6:
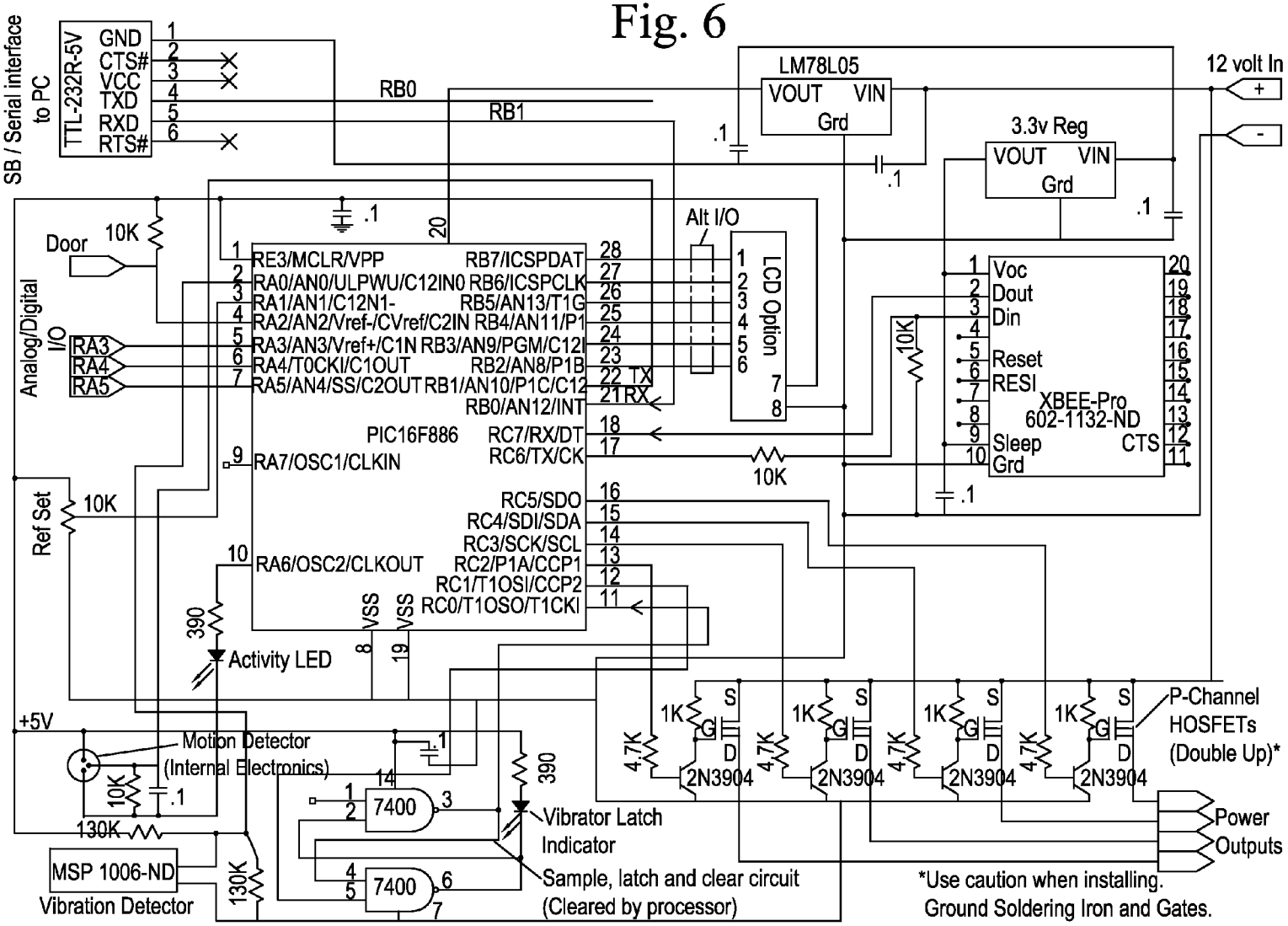
FIG. 6 depicts a schematic of one embodiment of the sensor unit of the present invention.
Figure 7:
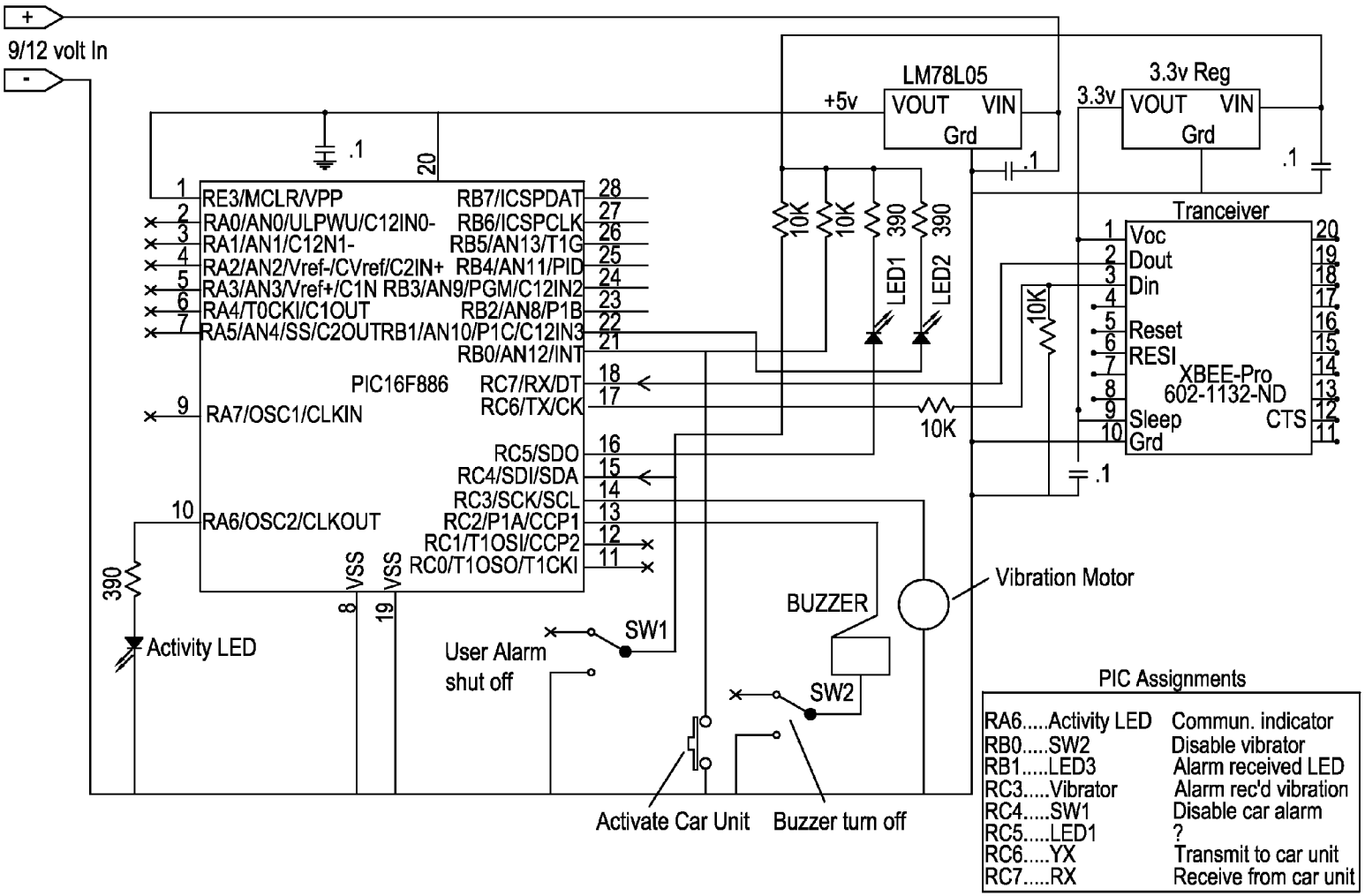
FIG. 7 depicts a schematic of one embodiment of the remote unit of the present invention.

FIG. 6 generally illustrates a schematic of a preferred embodiment of a sensor unit 10 of the present invention. Similarly, FIG. 7 generally illustrates a schematic of a preferred embodiment of a remote unit 30 of the present invention. A person of ordinary skill in the art will understand the scope of the disclosure from the numerous structures and functions taught by such exemplary schematics of potential embodiments of components of the present invention.

A unique aspect of the invention is that both the sensor unit and the remote unit of the invention may be portable. Thus, the portable sensor unit of the invention need not be permanently attached or hard wired into to the object to be monitored because the sensors may be contained with the transceiver in a single physical package, and thus the sensor unit of the invention may be moved from object to object as the user desires. No external wiring of sensors into the sensor unit is required in this preferred embodiment Besides the unique nature of its portability, the system 100 of the present invention may be embedded into technological devices in a near limitless variety of areas including but not limited to all possible vehicles including two wheeled (e.g. motorcycles, scooters, etc.), three wheeled, and four or more wheeled vehicles. The present inventive system 100 remains functional over a very wide range that may function at a distance in excess of a one mile radius and may alert a user in nearly all closed locations that are within the specified range of the system 100. As examples, the system 100 of the present invention may further be attached to or integrally embedded into portable electronic, communications, and/or Internet-capable devices including but not limited to laptops, notebook computers, mini portable computers, peripheral devices such as iPhones®, iPods®, iPads® sold by Apple, Inc., and other similar devices.

Additional functionality of the present invention may include embedding the system 100 of the present invention into devices such as laptops, notebooks, desktops, and other forms of standalone computer equipment or electronic devices wherein these devices may be turned on with the remote unit 30 of the system 100. Such an advantage may allow the equipment to be immediately ready for use by the party as well as having additional security features added therein. A preferred embodiment of such additional security features may include interfacing the system 100 of the present invention with the power supply of devices such as laptops, notebooks and other similar equipment so that the equipment will not turn on without initially being activated by the remote unit 30, thus rendering the equipment useless if someone steals it, as the equipment will not be able to initialize or power on without first receiving a signal from the remote unit 30. Such a "kill switch" security feature may be activated and deactivated from the remote unit 30 as required by the user and thereby serve as an additional theft deterrent.

In other forms of use, the portability and lack of any required wire attachments may be exploited to the benefit of the user. A user may simply toss or otherwise place the sensor unit 10 on or in the object to be protected and turn the sensor unit 10 to its sensor ON status by using the remote unit 30. The user may then feel safe and secure about the object being protected as the one or more alarms 33 on the remote unit will alert the user to object movement. The system 100 of the present invention may be used to protect against unwanted movement of automobiles, motorcycle, mopeds, scooters, other vehicles, briefcases, purses, residential and commercial safes, office drawers where important files are stored, windows, electronic devices such as laptops, notebook computers, PDAs, mobile telephones, MP3 players, and any other valuable assets or articles that the user desires to protect against unconsented movement using the present inventive portable alarm system 100.

The respective components of the sensor unit 10 and/or remote unit 30 may be constructed from materials capable of withstanding temperature ranges from below 35 degrees Fahrenheit to above 100 degrees Fahrenheit thereby allowing for potential use of the system 100 outdoors or in extreme environment conditions wherever object protection and/or theft deterrence is needed.

I claim:

1. An alarm system comprising:

a portable sensor unit comprising at least one sensor in electrical communication with at least one sensor unit transceiver, said at least one sensor having a sensor trigger level and wherein said at least one sensor unit transceiver is adapted to transmit an alarm signal when said sensor trigger level is exceeded;

a portable remote unit comprising at least one remote unit transceiver and at least one alarm in electrical communication with said remote unit transceiver;

wherein said remote unit transceiver is adapted to receive said alarm signal from said at least one sensor unit transceiver, and wherein said at least one remote alarm is adapted to produce an alarm indication when said at least one remote unit transceiver receives said alarm signal;

wherein said at least one sensor is further comprised of a plurality of sensors selected from the group consisting of vibration sensors, noise sensors, and motion sensors;

wherein said at least one sensor unit transceiver and said at least one remote unit transceiver are further defined as radio frequency transceivers;

wherein said at least one sensor unit is further comprised of a sensor unit microcontroller in electrical communication with said at plurality of sensors; and said sensor unit microcontroller is in electrical communication with said at least one transceiver; and said at least one sensor unit is further comprised of a sensor unit microcontroller readable memory containing instructions for determining that a predefined sensor trigger level has been exceeded and causing said sensor unit transceiver to transmit said alarm signal to said remote unit; and wherein said sensor unit is further comprised of a switch in electrical communication with said sensor unit microcontroller wherein said switch is adapted to turn said sensor unit off, and wherein said sensor unit microcontroller readable memory is further comprised of instructions to cause said sensor unit transceiver to transmit a signal to said remote unit transceiver indicating that said sensor unit is off.

2. The alarm system of claim 1, wherein said sensor unit is further comprised of at least one light emitting indicator which is in electrical communication with said microprocessor, and wherein said light emitting indicator signals a system activation status of said sensor unit.

3. The alarm system of claim 2, wherein said remote unit is further comprised of at least one light emitting sensor which is adapted to indicate a system activation status of said sensor unit.

4. The alarm system of claim 3, wherein said remote unit is further comprised of a remote unit microcontroller in electrical communication with a first remote unit switch having a first position and a second position, and a remote unit microcontroller readable memory, wherein said remote unit microcontroller readable memory further comprises instructions for reading said first remote unit switch position and causing said alarm indication to produce vibration only if said first remote unit switch is in said first position, and causing said alarm indication to produce vibration and sound if said first remote unit switch is in said second position.

5. The alarm system of claim 4, wherein said remote unit is further comprised of a second remote unit switch having a sensor unit activate state and wherein said remote unit microcontroller readable memory further comprises instructions for reading said state of said second remote unit switch and for transmitting a signal to said sensor unit causing said sensor unit to become active when said second remote unit sensor is in said sensor unit activate state.

6. The alarm system of claim 5, wherein said remote unit is further comprised of a third remote unit switch having a sensor unit deactivate state and wherein said remote unit microcontroller readable memory further comprises instructions for reading the state of said second remote unit switch and for transmitting a signal to said sensor unit causing said sensor unit to deactivate when said third remote unit switch is in said sensor unit deactivate state.

7. The alarm system of claim 1, wherein said remote unit is further comprised of at least one light emitting sensor which is adapted to indicate a system activation status of said sensor unit.

* * * * *